United States Patent [19]

Tagomori

[11] Patent Number: 4,912,912

[45] Date of Patent: Apr. 3, 1990

[54] CONTROL APPARATUS IN STRAPPING MACHINE

[75] Inventor: Tsutomu Tagomori, Yokohama, Japan

[73] Assignee: Strapack Corporation, Tokyo, Japan

[21] Appl. No.: 196,471

[22] Filed: May 20, 1988

[30] Foreign Application Priority Data

May 30, 1987 [JP] Japan ..... 62-133532

[51] Int. Cl.[4] ..... B65B 13/22; B65B 13/06; B65B 13/32

[52] U.S. Cl. ..... 53/589; 100/29; 100/32

[58] Field of Search ..... 100/2, 4, 17, 25, 29, 100/32; 53/399, 589, 389

[56] References Cited

U.S. PATENT DOCUMENTS

| | | | |
|---|---|---|---|
| 3,269,300 | 8/1966 | Billett et al. . | |
| 3,577,909 | 5/1971 | Takano et al. | 100/4 |
| 3,946,659 | 3/1976 | Gutjahr et al. | 100/4 |
| 4,020,756 | 5/1977 | Weiss | 53/589 X |
| 4,218,969 | 8/1980 | Kasuga | 100/32 |
| 4,378,262 | 3/1983 | Annis, Jr. | 100/29 X |
| 4,724,659 | 2/1988 | Mori et al. | 53/589 |

*Primary Examiner*—Horace M. Culver

*Attorney, Agent, or Firm*—Burns, Doane, Swecker & Mathis

[57] ABSTRACT

A strapping machine for applying a band around an article comprises motor-driven rollers for advancing and retracting the band, and a band handling mechanism for fusing and cutting the band. The various band moving and handling operations are performed by cams mounted on a motor driven cam shaft. The rotation of the cam shaft is controlled by a sensor-actuating disk which rotates with the cam shaft. A photosensor is disposed at a fixed sensing position adjacent the disk. The disk includes circumferentially spaced light admitting slits which sequentially actuate the photosensor as the cam shaft rotates. The photosensor actuates a timer in an electronic control circuit for controlling rotation of the cam shaft.

6 Claims, 4 Drawing Sheets

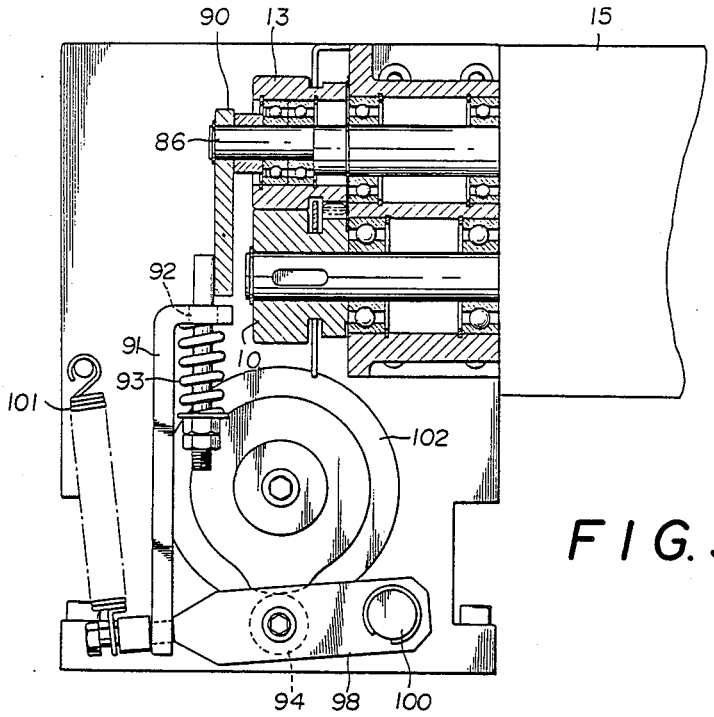
FIG. 3(B)
FIG. 4
PRIOR ART
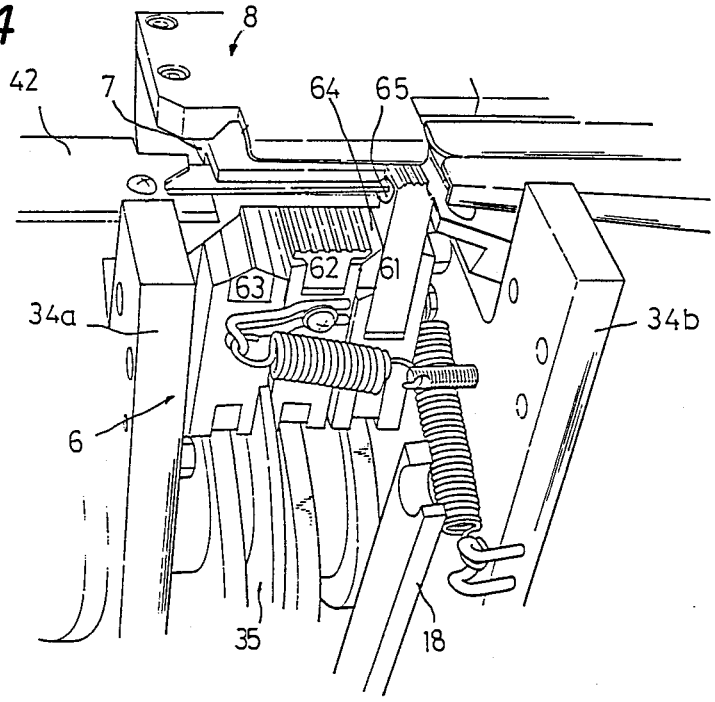

CONTROL APPARATUS IN STRAPPING MACHINE

FIELD OF THE INVENTION

The present invention relates to a control apparatus in a strapping machine and more particular to an apparatus for continuously controlling the starting and completion of various processes such as a process for grasping the front end of a band by means of a press member in one process of strapping, a process for reversely rotating a feed roller which winds the band around an article to be strapped, a tightening process for tightly binding the band against the article to be scrapped, a process for cutting the band-feeding end, a process for fusing the band-joining portion, a process for returning the band to the original position of the press member, and a process for forward rotation of the feed roller for feeding the band toward the outside of the main body.

DESCRIPTION OF THE PRIOR ART

The control apparatus in the strapping machine is provided, as illustrated in FIGS. 4 to 6, with a cam shaft 4 directly connected to the output shaft 2 of a speed reducer 31 which is connected to a motor (not shown) through the intermediary of an electromagnetic clutch. The cam shaft 4 is supported by frames 34*a* and 34*b* arranged in an adequately spaced relation; a number of cams 35 are attached to the cam shaft 4 so as to engage respective press members 6 provided between the frames 34*a* and 34*b* and a band guide 7. Limit cams 41 are secured, by means of a screw 16, to a limit cam shaft 40 extended from the output shaft 2 of the speed reducer 31 in a direction opposite to the frame 34*a* for being capable of adjusting the positions of the convex portions of the limit cams 41. Limit switches L3, L1, and L2 attached, through the intermediary of bracket 45, to positions wherein switch rods can be pressed by means of the convex portions of a plural number of limit cams 41*a*, 41*b*, and 41*c*. Such a structure is known from U.S. Pat. No. 3,269,300.

In a situation illustrated in FIG. 4 showing the original positions of the respective members, the cam shaft motor starts rotation when a starting switch (not shown) is turned ON to cause the cam shaft 4 and the cams 35 to be rotated through the intermediary of the speed reducer 31 whereby a pressing portion 61 on the right side portion in the press members 6 grasps the front end of the band between the pressing portion 61 and the slide table 8. In this case, the limit cam 41*b* which rotates in synchronism with the cam shaft 4 turns the limit switch L1 ON to produce a reverse rotation signal which stops the cam shaft motor and starts the reverse rotation of a motor which is coupled to a feed roller 43 and connected to a drive control circuit. The feed roller 43 restores or retracts the band, which is removed from a band guiding arch on the main body of the strapping machine and is pulled against the article to be strapped. In a tightening method effected by the tension arm system illustrated in the drawings, the amount of band restoration in the reverse rotation system is set to a desired amount by means of the given setting time of a timer which is operated by the reverse rotation signal of the limit switch L1. After the passage of the setting time of the timer, the reverse rotation of the motor coupled to the feed roller 43 is stopped and the cam shaft motor begins to rotate again. The cam shaft 4 thus rotates and causes a tension cam 46 also to rotate and displace a cam follower 48 which is mounted on a tension arm and which engages a cam surface 47. As a result, the tension arm 44 grasps the band and swings at a predetermined degree of stroke, whereby the band is tightened by the tension arm 44. A pressing portion 62 is displaced by the cam 35 of the rotating cam shaft 4 and grasps the band feeding end. A heater (not shown) on a heater crank 18 is displaced as a pressing portion 63 is raised and the tension arm 44 is slightly restored to release the band-tightening state. The edge of a cutter in the pressing portion 63 smoothly cuts the band and joined portions are pressed and fused together by the heater. The middle pressing portion 63 is temporarily lowered to remove the heater and then raised, and the joined band portions are then pressed and fused for a definite time, whereupon the respective members are restored to the original position in FIG. 4 together with the band guide 7, the slide table 8, and the left band way flap 42. The above operations are performed as a series of operations by means of the continuous rotation of the cam shaft 4. The limit cam 41*c* on the limit cam shaft 40 is also rotating in this case and the limit switch L2 is turned ON by means of the limit cam 41*c* concurrently with the restoration of the respective members to the original position thereby producing a forward rotation signal to forward rotate the motor such that the feed roller 43 feeds the band into the guide arch. The forward rotation time of the motor is controlled by the timer and set longer than the time necessary to feed the band around the entire arch. Thereafter, the limit cam 41*a* on the limit cam shaft 40 engages the limit switch L3 to stop the cam shaft motor. In the meanwhile, the forward rotation of the feed roller 43 has fed the band to the band guiding arch on the main body whereby the front end of the band has reached below the slide table 8.

One rotation of the cam shaft effects one strapping cycle, in which the starting and finishing signals are controlled by the limit cams 41 on the limit cam shaft 40 which rotates in synchronism with the cam shaft 4 and the limit switches L1, L2, and L3 which act in association therewith.

The above-described apparatus requires a very troublesome adjusting operation in which a number of the limit cams 41 must be fixed by the screw 16 at a position at which the limit switches L1, L2, and L3 are properly actuated by the limit cams 41. An additional disadvantage involves the fact that conventional limit switches are prone to malfunction as the result of the presence of band scrap and dust and require a number of parts, rendering the machine large and expensive.

SUMMARY OF THE INVENTION

It is an object of the present invention to solve the above problems by means of a structure occupying a very small space and having few parts. The strapping machine includes a band-feeding and tightening mechanism necessary for strapping, a mechanism for cutting the band feeding end, and the fusion mechanism of the band joining portion, and a disk having circumferentially spaced sensor actuating-structures such as slits, magnets, or projections. The disk is secured to a motor-driven cam shaft, while a sensor of a photoconductive, an electromagnetic conversion, or a contact switch system is provided at a fixed sensing position adjacent the outer periphery of the disk. The control means is further so constructed as to apply the detection signal of the sensor to the drive control circuit in the motor coupled to the cam shaft motor and the rollers through the intermediary of a control circuit. Because the disk rotates in accordance with the action of the mechanism for grasping the front end of the band composed of the respective press members, the circumferentially spaced sensor-actuating structures are successively detected by the sensor, whereby the control circuit to which the detection signal is applied delivers the start and finish signals of the respective action to the drive control circuit in the motor connected to the cam shaft motor and the roller.

BRIEF DESCRIPTION OF THE DRAWINGS

FIGS. 1 to 3 illustrate a preferred embodiment of the present invention and FIGS. 4 to 6 illustrate the prior art, wherein:

FIG. 1 is a front elevational view of a sensor and sensor-actuating portion of a strapping machine according to the invention;

FIG. 2 is a side elevational view of the portion of the machine depicted in FIG. 1;

FIG. 3B is a front view of a mechanism for controlling the band-advancing and retracting rollers with a portion thereof broken away;

FIG. 4 is a perspective view of a band-handling mechanism in which the band is gripped, fused, and cut;

FIG. 6 is a perspective view of a prior art sensor and sensor-actuating mechanism for a strapping machine.

DETAILED DESCRIPTION OF A PREFERRED EMBODIMENT OF THE INVENTION

The detail of the present invention is described below based on the embodiment with reference to the accompanying drawings.

Figure 2:
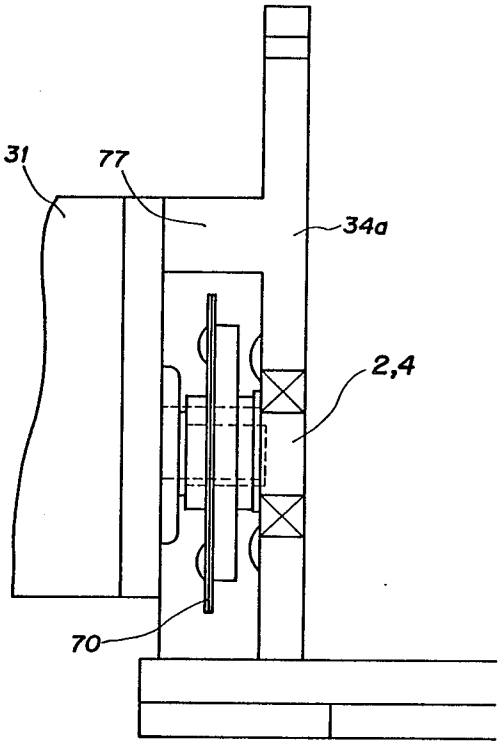
Figure 1:
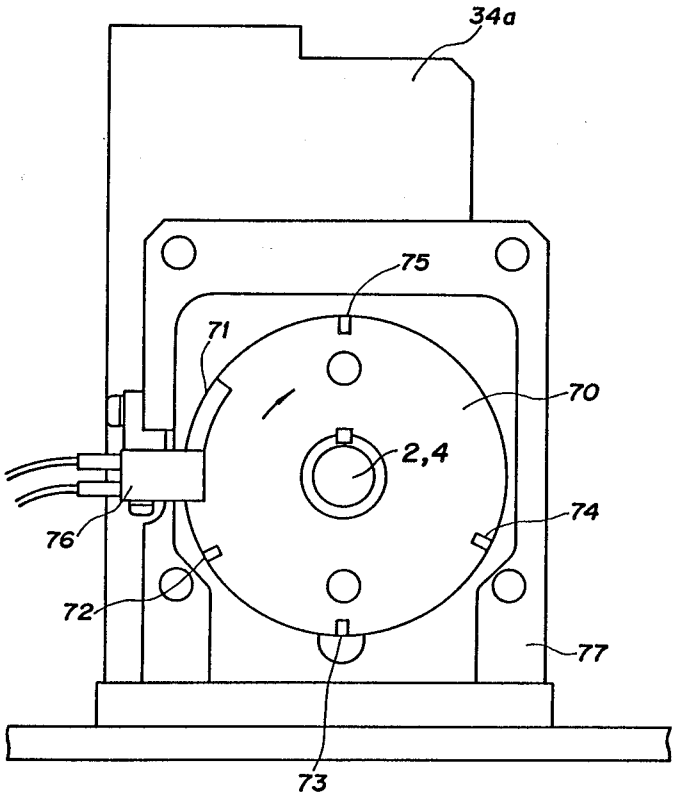
Figure 5A:
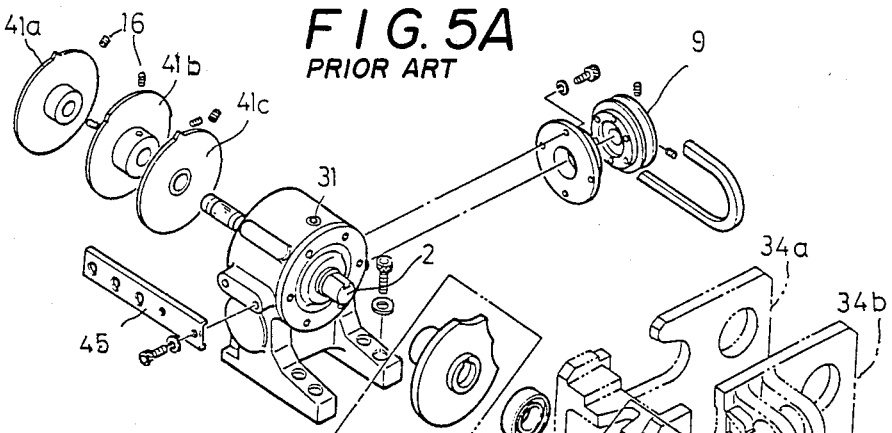
FIG. 5A PRIOR ART
FIG. 5A is a perspective exploded view of a prior art control mechanism of a strapping machine.
Figure 5B:
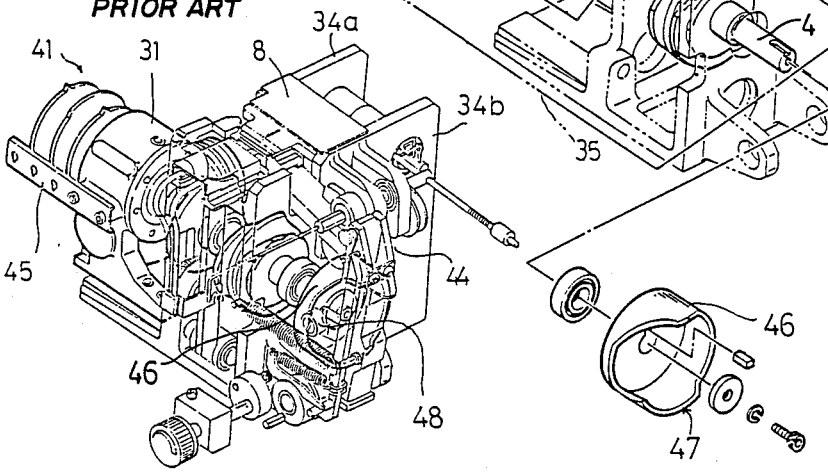
FIG. 5B PRIOR ART
FIG. 5B is a perspective view of FIG. 5A after the parts have been assembled.
Figure 6:
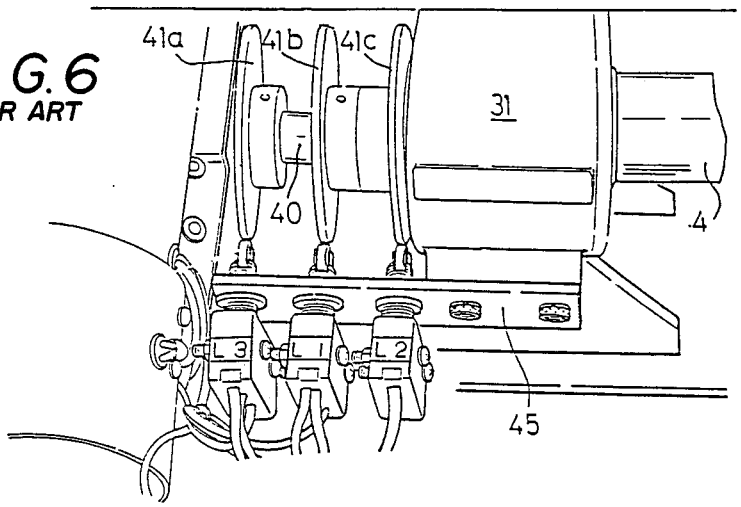
FIG. 6 PRIOR ART

Referring to FIGS. 1 and 2, one disk 70 is keyed onto an output shaft 2 between one frame 34*a* and a speed reducer 31 or onto a cam shaft 4 directly connected to the output shaft. Five sensor-actuating structures in the form of slits 71 to 75 are provided on the outer circumference of the disk 70 at a predetermined interval. Among the slits, three slits 72, 74 and 75 are provided at nearly 120° intervals. The slit 73 is formed diametrically opposite to the slit 75. The slit 71 is provided in the nearly middle portion between the slit 72 and the slit 75 and extends along the outer circumference somewhat longer than any of the other slits 72 to 75. The length of the slit 71 is such that the light from the later-described two photosensors or two light sources can be received simultaneously. On the contrary, the lengths of the slits 72 to 75 are such that one light source from the photosensor can be received. The embodiment illustrated in the drawings has a structure similar to those illustrated in FIGS. 4 to 6 except that (a) the cam shaft motor is composed of a brake-equipped geared motor capable of free forward and reverse rotation connected to a drive control apparatus in which the control circuit is composed of an electronic circuit, (b) the output shaft 2 is integrally or directly connected to the cam shaft 4 and is secured to a flange 77 projected into the frame 34*a* in order to assure space for attaching the disk 70, and (c) a slide table switch L5 for detecting the arrival of the band front end fed toward the outside of the main body is provided below the slide table 8.

In the drawing, numeral 76 denotes a sensor in the form of an amplifier-containing microphotosensor placed at a fixed sensing position on flange 77 for detecting the portions 71–75 to produce a signal. The sensor 76 may comprise two parallel photosensors or one photosensor having two light sources. When the switch is actuated to generate an OFF signal, the OFF signal is applied to a conventional control circuit composed of the IC of the main substrate and counted to control the cam shaft motor and a speed reducer-equipped motor 15 which are the peripheral devices thereof connected to a triac substrate through the intermediary of a channel device.

Figure 3A:
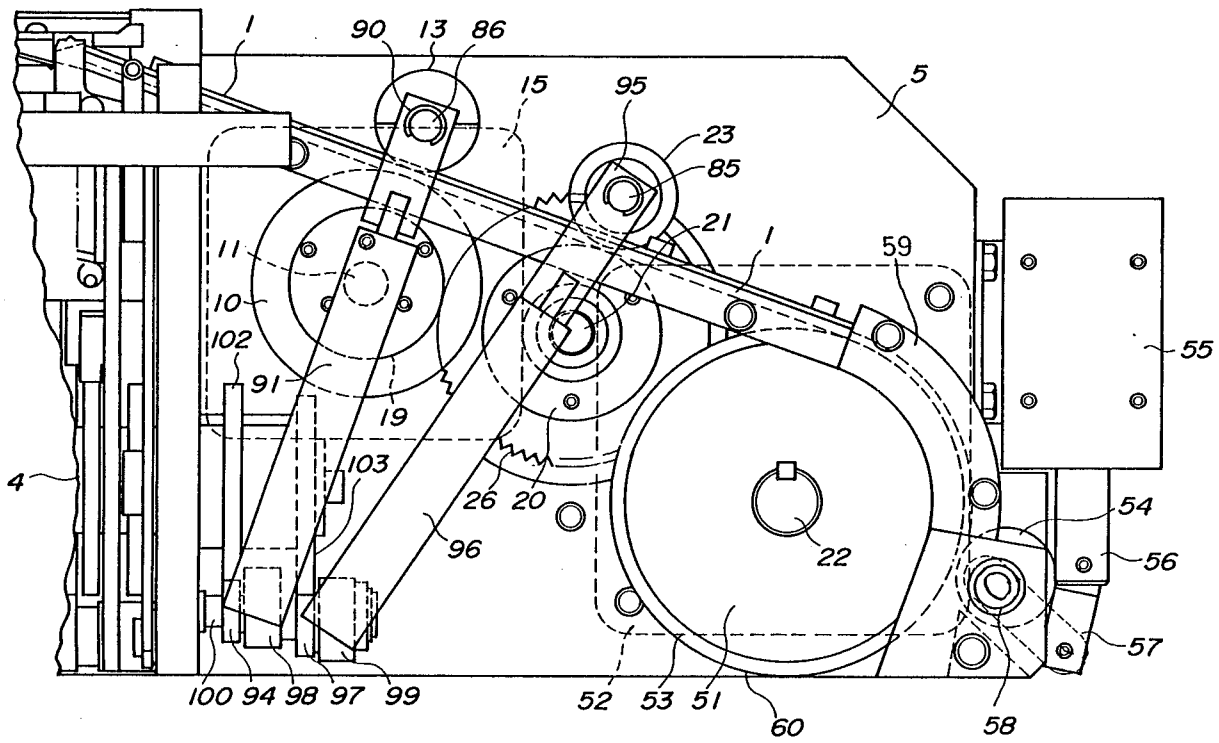
FIG. 3A is a side elevational view of a band-advancing and band-retracting mechanism of the machine.

Referring to FIGS. 3A and 3B, a forward rotating roller 10 constituting the feed roller and a reverse rotating roller 20 constituting a return roller are arranged in front of a band chute 1. The speed reducer-equipped motor 15 is directly connected to the drive shaft 11 of the forward rotating roller 10 and the speed reducer-equipped motor 15 is also connected to the drive control circuit composed of a triac substrate in which the control circuit is composed of an electronic circuit. A gear 19 provided on the drive shaft 11 meshes with a gear 26, having a diameter larger than that of the gear 19, provided on the shaft 21 of the reverse rotating roller. Accordingly, the forward roller 10 and the reverse rotating roller 20 rotate at any time in opposite directions to each other.

Numerals 13 and 23 denote feed and reverse touch rollers which are locker rollers and have a similar structure. The structure related to both touch rollers are supported by eccentric shafts 86 and 85, to the ends of which the upper ends of acting levers 90 and 95 are pivotally attached. The lower ends of these levers 90, 95 are loosely inserted into a hole 92 bored through the bent pieces of L-shaped interlocking levers 91 and 96 are connected to the acting lever 90 through the intermediary of a spring 93. The lower end of the interlocking lever 91 and the lower end of the interlocking lever 96 are attached to the tips of arm levers 98 and 99 having rolls 94 and 97. One end of each of the arm levers 98 and 99 is pivotally supported by a shaft 100 mounted on the base plate, and a spring 101 is locked at another end thereof to energize the arm lever in the direction of the band chute.

Cams 102 and 103 are mounted on a shaft which is the extension of a cam shaft 40, which cam shaft is provided for actuating a band fusion mechanism 50 composed of a known band gripper, a heater and a center press. The cams are brought into contact with the rolls 94 and 97 of the arm levers 98 and 99, respectively, to perform an interlocking action with the interlocking levers 91 and 96, and thus with the acting levers 90 and 95.

A portion of the circumference of a tension roller 51 is disposed at the rear end of the chute 1 and the drive shaft 22 of the tension roller 51 is directly connected to a tightening motor 52 composed of a brake-equipped geared motor attached to the reverse side of a base plate 5. The tension roller 51 is a large-diameter roller and an elastic body of a large friction resistance, formed of for example of urethane, is adhered to the outer periphery of the metallic roller. Midway along the width direction of the outer peripheral surface, the elastic body 53 is provided with a notch in which is disposed an annular member 60 in the form of a thrust washer. The washer can be formed by coating a metal material which is harder and has a smaller friction resistance than the elastic body, such as stainless steel is embedded. The annular member 60 is projected from the outer periphery of the elastic body 53 by a slight distance such as 0.2 to 0.3 mm.

A tension touch roller 54 is supported by an eccentric shaft 58. One end of a crank 57 connected to the rod 56 of a solenoid 55 is connected to the head of the eccentric shaft 58. The outer periphery of the tension touch roller 54 is so constructed as to be capable of contact with and separation from the outer periphery of the tension roller 51 by means of expansion and contraction of the rod 56.

A guide chute 59 covers a portion of the outer periphery of the tension roller 51 through the intermediary of a gap for allowing the band to pass. One end thereof faces the rear end of the band chute 1 and the other end thereof faces a portion of the outer periphery of the tension touch roller 54.

The band is initially wound around an article to be strapped through a band guiding arch (not shown) on the main body of a strapping machine or manually so that the front end of the band has reached a band handling mechanism 50. Because the convex portion of the cam 102 (103) does not yet push down the roll 94 (98), a gap thickness exceeding that band is formed between the feed roller 10 and the feed touch roller 13, such that there is no effect on the band in the band chute 1. The relation between the reverse roller 20 and the reverse touch roller 23 is also the same as the rollers 10, 13.

The cam shaft 4 is rotated in response to actuation of a starting switch and a grasping mechanism in the band handling mechanism 50 grasps the band front end. Because of the cam which is simultaneously rotating, the acting lever 95 is pushed down through the intermediary of the roll 97, the arm lever 99, and the interlocking lever 96. The eccentric shaft rotates in the form of an arc to push down the reverse touch roller 23 into compressive contact with the reverse roller 20. Accordingly, the band-feeding end in the band chute 1 is restored or retracted by pair of rotatable driving rollers 20, 23 at high speed (the primary tightening around the article).

In the meantime, since the turning-on of the starting switch causes the disk 70 to rotate, the photosensor 76 receives the light through the slit 72 at the same time as the grasping of the band front end to emit a detection signal whereby a first count is applied by a counter of the control circuit to convert the signal in the control circuit into a reverse rotation signal. An electromagnetic brake 9 connected to the main substrate of the reverse rotation signal is thus turned ON to stop the rotation of the cam shaft motor.

The solenoid 55 is excited by the detection signal and the tightening motor 52 starts reverse rotation of the tension roller 51, and the tension touch roller 54 is brought into compressive contact with the tension roller 51 through the intermediary of the crank 57 whereby the band is tightened by the periphery of the elastic body 53.

Upon expiration of the time set by a timer in the control circuit operated by turning the solenoid 55 ON, the cam shaft motor rotates again and the reverse rotation of the tightening motor 52 is stopped. The forward rotation of the cam shaft motor causes the cam shaft 4 to rotate again, whereupon the band feeding end is grasped between a left pressing portion 63 and the slide table 8, the arm lever 99 swings, and the touch roller 23 and the roller 20 release the band. The disk 70 also is rotating simultaneously so the photosensor 76 receives light through the slit 73 to deliver a detecting OFF signal and a second count is applied to the control circuit by a counter to convert the signal into a release signal, which releases the excitation of the solenoid 55. The cam shaft 4 which continues rotation raises the middle pressing portion 62 in the band fusion mechanism. A heater (not shown) is inserted between the joined band portions to fuse same. The middle pressing portion 62 descends to back the heater from the fused band. The middle pressing portion 62 ascends again to press the fused band against the slide table 8. The photosensor 76 receives light through the slit 74 to produce a detecting OFF signal and a third count is applied in the control circuit to convert the signal into an intermediate stop signal. The forward rotation of the cam shaft 4 is stopped and the fused band is cooled and solidified up to the point when the time set by the timer, which is operated by the intermediate stop signal expires. When the time set by the timer expires, the cam shaft 4 rotates forwardly again and the photosensor 76 receives the light through the slit 75 to produce a detecting OFF signal. A fourth count is applied in the control circuit to convert the signal into a forward rotation signal. The forward rotation signal causes the forward rotation of the cam shaft 4 to stop after the forward rotation roller 10 and the forward rotating touch roller 13 have been placed in a state as illustrated in FIG. 3B to bring the band into compressive contact between both rollers whereby a predetermined amount of the band is fed to the guide arch.

When the band is thus fed and the front end thereof turn ON a switch for detecting the arrival of the front end of the band below the slide table 8, the speed reducer-equipped motor 15 connected to the drive shaft 11 of the forward rotating roller stops and the cam shaft 4 performs forward rotation. The rotation of cam 102 releases the compressive contact of the forward rotating roller 10 with the forward rotating touch roller to return the respective portions to the original position (refer to FIG. 3A). In this case, two light sources of the photosensor 76 receive light simultaneously through the slit 71 and the count is reset in the counter of the control circuit to convert the signal into an original positional signal. The original position signal stops the rotation of the cam shaft motor.

At the same time of completion of one process of strapping as described above, preparation for the subsequent strapping process has been completed. In other words, turning the start button ON repeats the above operations.

The sensor actuating structures of the disk 70 may, instead of slits, comprise magnets embedded on the disk or projections formed on the disk. In the latter case, a Reed switch, a limit switch, or an access sensor engageable with the projections would be used as a sensor.

What is claimed is:

1. In a strapping machine for applying a band around an article, said machine including first motor-driven roller means for advancing a band, second motor driven roller means for retracting the advanced band to apply the band against an article, gripping means for gripping a leading end of the advanced band during such retraction of the band, fusing means for fusing the retracted band, cutting means for cutting the fused band, a motor-driven cam shaft, a plurality of cams on said cam shaft for actuating said gripping, fusing and cutting means in response to rotation of said cam shaft, sensor-actuating means operably connected to be rotated with said cam shaft, and sensor means disposed adjacent said sensor-actuating means and arranged to be actuated thereby, said sensor means operably connected to an electronic control circuit for controlling rotation of said motor-driven cam shaft, the improvement wherein said sensor-actuating means comprises a single disk operably connected to be rotated with said motor-driven cam shaft, said disk including a plurality of circumferentially spaced substantially coplanar sensor-actuating structures, said sensor means comprising a sensor located at a fixed sensing position relative to said disk and arranged to be sequentially actuated by said sensor-actuating structures as said sensor-actuating structures reach said sensing position.

2. A strapping machine according to claim 1, wherein said sensor comprises photosensor means and said sensor-actuating structures includes slits formed in said disk and arranged such that said photosensor means receives light therefrom.

3. A strapping machine according to claim 2, wherein said photosensor means comprises a set of two adjacent photosensors, some of said slits being sized to admit light to only one said photosensor at a time, and another of said slits being sized to admit light to both photosensors simultaneously.

4. A strapping machine according to claim 3, wherein said some slits are four in number.

5. A strapping machine according to claim 1, wherein said electric control circuit includes a timer actuated by said sensor for periodically stopping said motor-driven cam shaft for predetermined intervals.

6. In a strapping machine for applying a band around an article, said machine including first motor-driven roller means for advancing a band, second motor driven roller means for affecting a retraction of the advanced band to apply the band against an article, gripping means for gripping a leading end of the advanced band during such retraction of the band, fusing means for fusing the retracted band, cutting means for cutting the fused band, a motor-driven cam shaft, a plurality of cams on said cam shaft for actuating said gripping, fusing and cutting means in response to rotation of said cam shaft, sensor-actuating means operably connected to be rotated with said cam shaft, and sensor means disposed adjacent said sensor-actuating means and arranged to be actuated thereby, said sensor means operably connected to an electronic control circuit for controlling rotation of said motor-driven cam shaft, the improvement wherein said sensor-actuating means comprises a single disk operably connected to be rotated with said motor-driven cam shaft, said disk including a plurality of circumferentially spaced light-emitting slits formed in said disk, said sensor means comprising photosensing means located at a fixed sensing position relative to said disk and arranged to receive light passing through said slits.

* * * * *